US010359232B2

(12) United States Patent
Juarez

(10) Patent No.: US 10,359,232 B2
(45) Date of Patent: Jul. 23, 2019

(54) BAG DRYING APPARATUS

(71) Applicant: Gilbert Juarez, San Diego, CA (US)

(72) Inventor: Gilbert Juarez, San Diego, CA (US)

( * ) Notice: Subject to any disclaimer, the term of this patent is extended or adjusted under 35 U.S.C. 154(b) by 123 days.

(21) Appl. No.: 15/477,664

(22) Filed: Apr. 3, 2017

(65) Prior Publication Data

US 2018/0283786 A1 Oct. 4, 2018

(51) Int. Cl.

| | |
|---|---|
| ***F26B 9/00*** | (2006.01) |
| ***F26B 21/00*** | (2006.01) |
| ***F26B 25/08*** | (2006.01) |

(52) U.S. Cl.

CPC ..... *F26B 9/003* (2013.01); *F26B 21/001* (2013.01); *F26B 21/008* (2013.01); *F26B 25/08* (2013.01)

(58) Field of Classification Search

CPC ..... F26B 9/003; F26B 9/10
USPC ..... 34/90, 622
See application file for complete search history.

(56) References Cited

U.S. PATENT DOCUMENTS 209,749 A * 11/1878 Brown ..... B65B 67/12 248/97
3,295,694 A * 1/1967 Nejezchleb ..... A47L 19/04 211/12
5,080,237 A 1/1992 Hefner
5,102,076 A 4/1992 North et al.
5,188,244 A * 2/1993 Hollstegge ..... A47L 19/04 211/13.1
5,405,018 A * 4/1995 Anthrop, Jr. ..... A47L 15/505 211/41.9
5,421,542 A 6/1995 Crutcher
5,778,556 A * 7/1998 Ohsugi ..... A43D 3/1408 211/34
5,862,606 A * 1/1999 Jannach ..... D06F 17/04 134/166 R
5,901,861 A 5/1999 Huguet
6,059,126 A * 5/2000 Miller ..... B65B 67/1227 211/12
6,243,967 B1 * 6/2001 Dovolas ..... F26B 25/18 211/13.1
6,640,982 B1 11/2003 Bjerke
7,121,017 B2 * 10/2006 DuRapau ..... A47L 23/205 34/381
8,186,075 B2 * 5/2012 Beckett ..... A47L 23/205 34/106
8,579,241 B2 * 11/2013 Baker ..... A43B 7/28 248/152
8,595,951 B2 * 12/2013 Peet ..... F26B 9/003 211/12
9,587,879 B1 * 3/2017 Mersinas ..... F26B 9/00
2018/0283786 A1 * 10/2018 Juarez ..... F26B 9/10
2018/0292131 A1 * 10/2018 Juarez ..... F26B 21/008

* cited by examiner

*Primary Examiner* — Stephen M Gravini
(74) *Attorney, Agent, or Firm* — Global Intellectual Property Agency, LLC; Daniel Boudwin

(57) ABSTRACT

A bag drying apparatus. The bag drying apparatus includes a panel having a panel slot with an open first end that is accessible from a first end of the panel. The panel is adapted to couple with a board with a board slot having an open first end accessible from a second end of the board. When the panel and board are interlocked, the bag drying apparatus is configured to receive and to maintain an inverted bag in an open position. In one embodiment, the bag drying apparatus is modular, allowing the selective configuration and customization of panels and boards.

20 Claims, 6 Drawing Sheets

BAG DRYING APPARATUS

BACKGROUND OF THE INVENTION

Field of the Invention

The present invention relates to a bag drying apparatus. More specifically, the present invention provides a bag drying apparatus adapted to receive and to maintain a bag in an open position.

Many people utilize plastic bags with sealable tops for storing food and snacks. These plastic bags are normally discarded after one use, as cleaning and otherwise maintaining them in a safe condition is not convenient. Once disposed of, these plastic bags remain in landfills for significant periods of time, as they do not degrade quickly. Further, disposal of the plastic bags after a single use requires the costly purchases of large quantities of bags.

Devices have been disclosed in the known art that relate to bag drying racks. These include devices that have been patented and published in patent application publications. These devices in the known art have several known drawbacks. For example, one bag drying rack includes a upstanding pole that can receive a bag. However, such a device is unstable and prone to tipping. Further, the device has no means of receiving bags of various sizes of multiple bags.

In light of the devices disclosed in the known art, it is submitted that the present invention substantially diverges in design elements from the devices in the known art and consequently it is clear that there is a need in the art for an improvement to existing bag drying apparatuses. In this regard the instant invention substantially fulfills these needs.

SUMMARY OF THE INVENTION

In view of the foregoing disadvantages inherent in the known types of bag drying apparatuses now present in the art, the present invention provides a new bag drying apparatus wherein the same can be utilized for providing convenience for the user when cleaning and drying bags for storing food and other items.

It is therefore an object of the present invention to provide a new and improved bag drying apparatus comprising a panel comprising a panel slot with an open first end that is accessible from a first end of the panel. The panel is adapted to couple with a board comprising a board slot having an open first end accessible from a second end of the board. When the panel and board are interlocked, the bag drying apparatus is configured to receive and to maintain a bag in an open position.

It is another object of the present invention to provide a bag drying apparatus configured to accommodate a variety of bag shape and sizes.

Another object of the present invention is to provide a bag drying apparatus with a fan for blowing air within the interior of a received open bag.

Yet another object of the present invention is to provide a bag drying apparatus that is adapted to be disassembled and stored in a generally flat configuration.

Another object of the present invention is to provide a bag drying apparatus that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
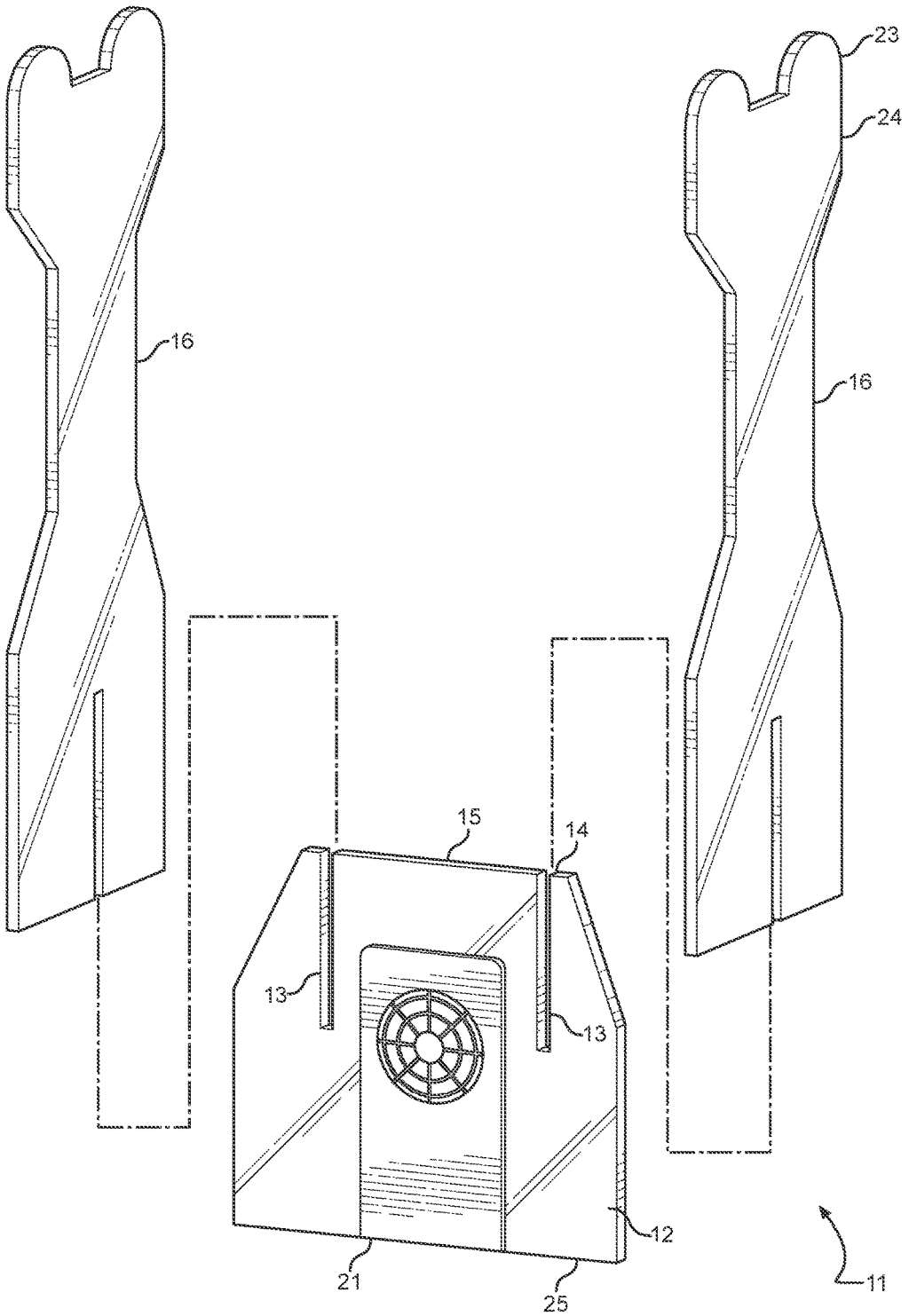
FIG. 1 shows an exploded view of one embodiment of the bag drying apparatus.

Reference is made herein to the attached drawings. Like reference numerals are used throughout the drawings to depict like or similar elements of the bag drying apparatus. For the purposes of presenting a brief and clear description of the present invention, the preferred embodiment will be discussed as used for drying plastic bags. The figures are intended for representative purposes only and should not be considered to be limiting in any respect.

Figure 2:
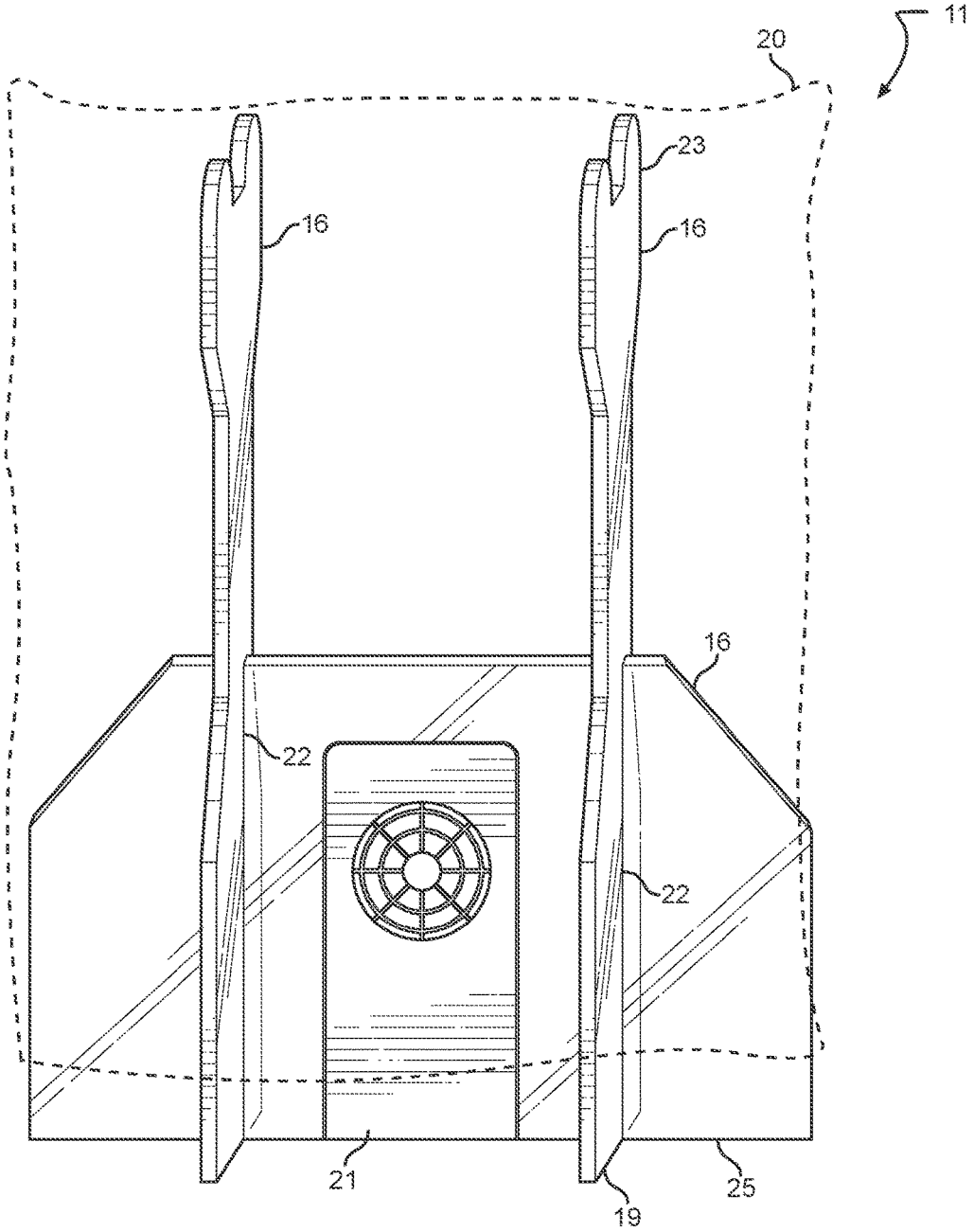
FIG. 2 shows a perspective view of one embodiment of the bag drying apparatus in one use.

Referring to FIGS. 1 and 2, there is shown an exploded view of one embodiment of the bag drying apparatus and a perspective view of one embodiment of the bag drying apparatus in one use, respectively. The bag drying apparatus 11 comprises a panel 12 having a panel slot 13 with an open first end 14 that is accessible from a first end 15 of the panel 12. In the shown embodiment, the panel 12 is a planar member that is oriented in an upright position. A board 16 includes a board slot 17 having an open first end 18 that is accessible from a second end 19 of the board 16. The panel slot 13 is configured to removably interlock 22 with the board slot 17.

In the shown embodiment, the panel slot 13 and the board slot 17 have an identical length such that they are fully received within each other when interconnected. In alternative embodiments, the dimensions of the panel slot 13 and board slot 17 may vary. The bag drying apparatus 11 is configured to receive and to maintain an inverted bag 20 in an open position allowing for the drying thereof. Further, a first end 24 of the board 16 includes one or more prongs 23 that protrude therefrom. The prongs 23 are adapted to engage with the received bag 20 so as to maintain the bag 20 in an open configuration. The second end 19 of the board 16 is configured to align with a second end 25 of the panel 13, such that the interlocked bag drying apparatus 11 is adapted to rest flush with a flat support surface.

Specifically refereeing to FIG. 1, the shown embodiment of the bag drying apparatus 11 includes a panel 12 with a number of panel slots 13 that corresponds to the number of boards 16. In this embodiment, the bag drying apparatus 11 is modular, allowing the selective configuration and customization of the panels 12 and boards 16. There are two panel slots 13 that are spaced at an interval and accessible from a common end of the panel 12. Further, the panel 12 includes a general trapezoidal shape. However, in alternative embodiments the panel 12 may include rectangular, or polygonal shapes. A fan 15 is disposed within the panel 12, wherein the fan 15 is adapted to increase the airflow and drying rate of an inverted bag 20 received thereon. The fan 15 is aligned along a same horizontal plane of the panel 12 and generally flush with the exterior thereof. Further, the boards 16 include a generally dumbbell shape having bulbous distal ends and a narrower connecting middle section. The dumbbell shape of the boards 16 provide minimal interference with the airflow of the surrounding area. However, in alternative embodiments, the boards 16 may have various other shapes, such as rectangular and polygonal. The bag drying apparatus 11 is adapted to be disassembled and stored in a generally flat configuration.

Figure 3:
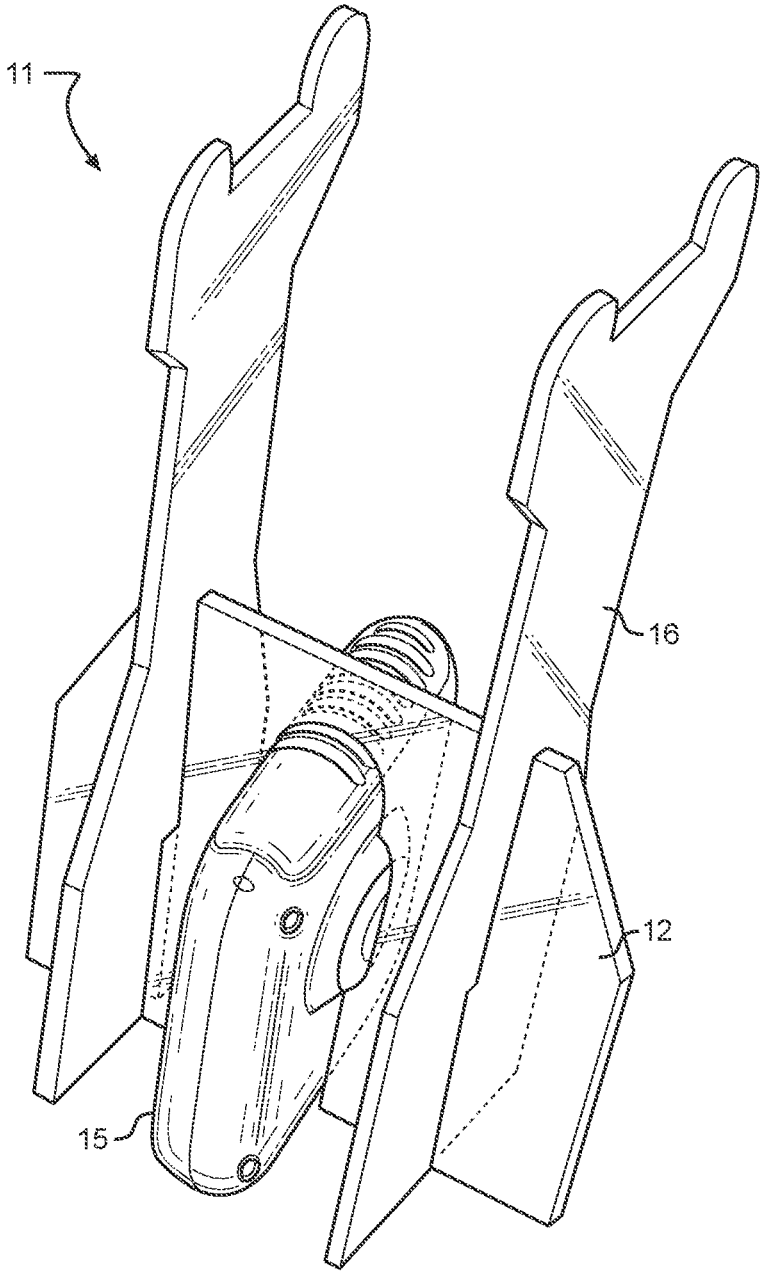
FIG. 3 shows a perspective view of a second alternative embodiment of the bag drying apparatus.
Figure 4:
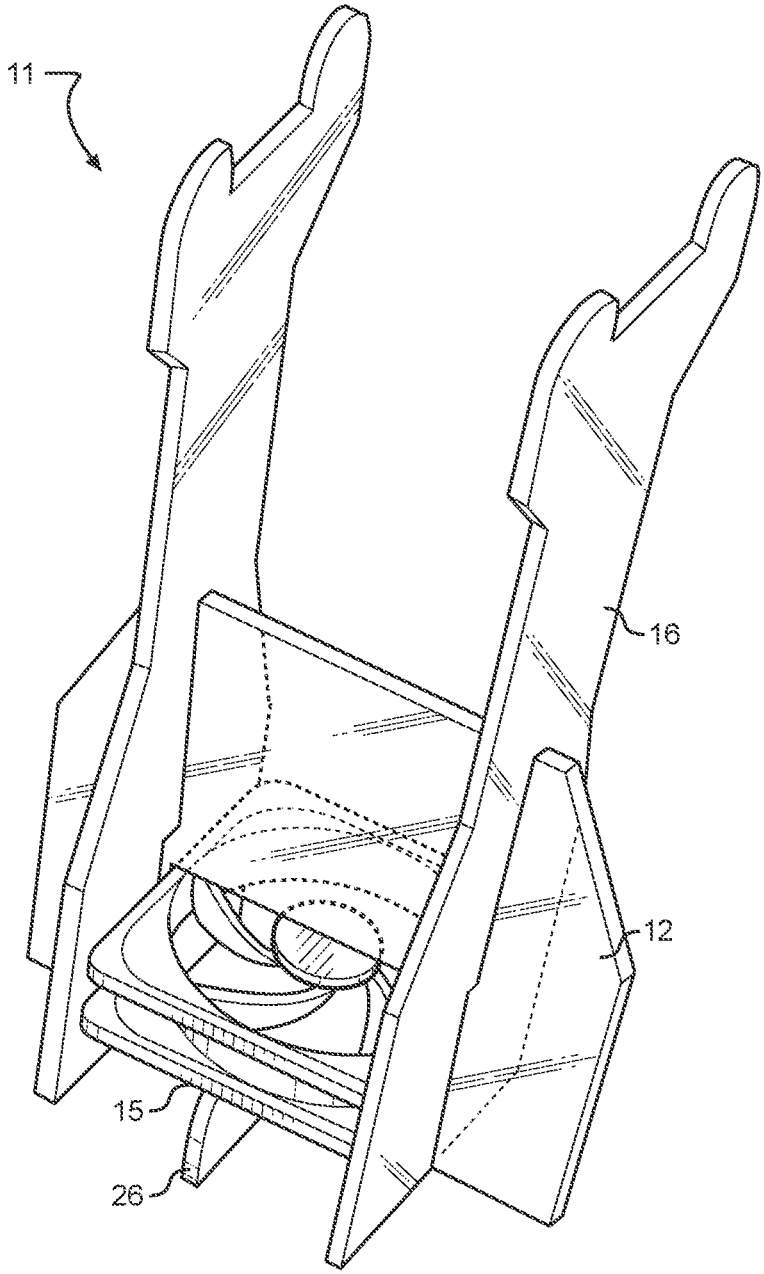
FIG. 4 shows a perspective view of a third alternative embodiment of the bag drying apparatus.

Referring to FIGS. 3-4, there is shown a perspective view of a second and third embodiments of the bag drying apparatus, respectively. Specifically referring to FIG. 3, the shown second embodiment includes a fan 15 aligned perpendicular to a horizontal plane of the panel 12 and perpendicular to the ground surface supporting the bag drying apparatus 11. In this embodiment, the panel 12 includes a cut-out region dimensioned to receive the fan 15 therein. Specifically referring to FIG. 4 the shown third alternative embodiment of the bag drying apparatus 11 includes a fan 15 aligned perpendicular to a horizontal plane of the panel 12 and parallel to the ground surface supporting the bag drying apparatus 11. In the shown embodiment, the fan 15 is further supported by a leg 26, wherein the leg 26 is disposed between a pair of boards 16, and through a panel 12.

Figure 5:
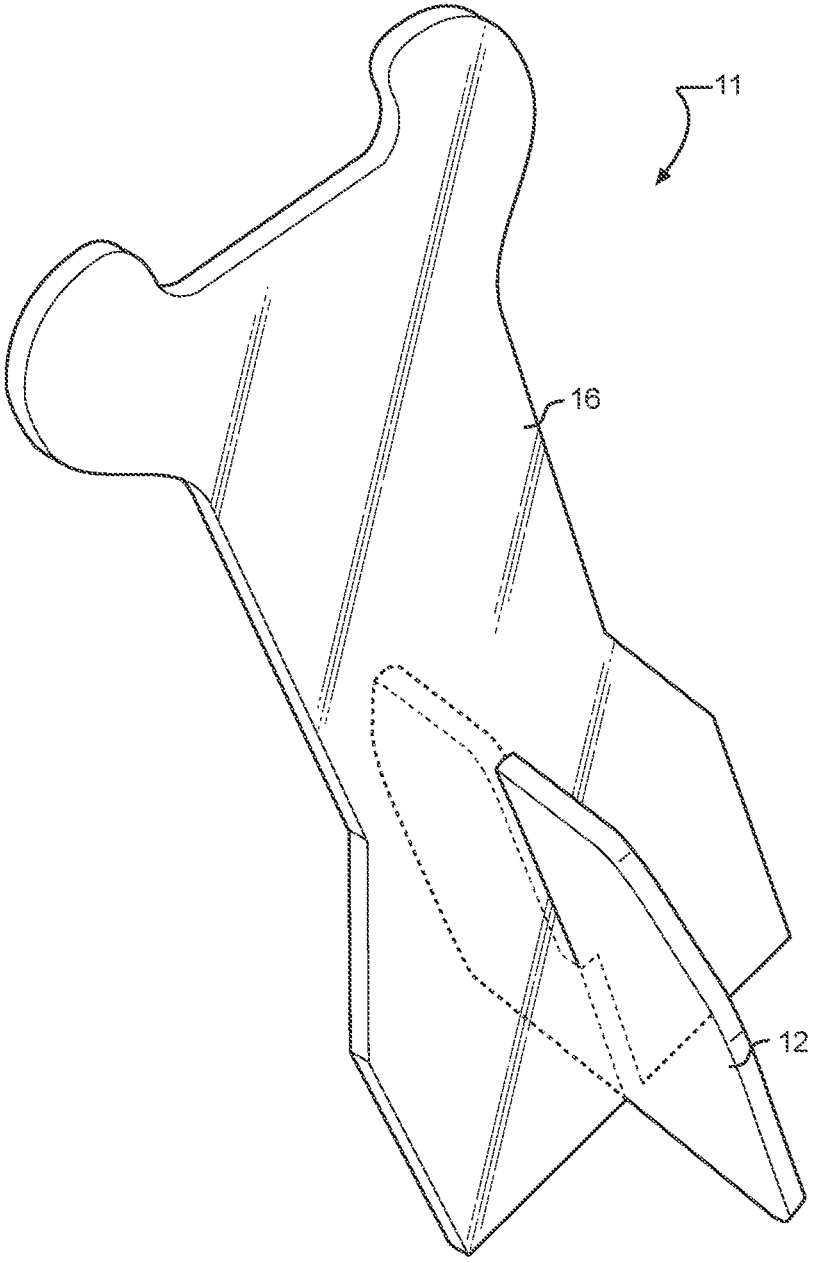
FIG. 5 shows a perspective view of a fourth alternative embodiment of the bag drying apparatus.
Figure 6:
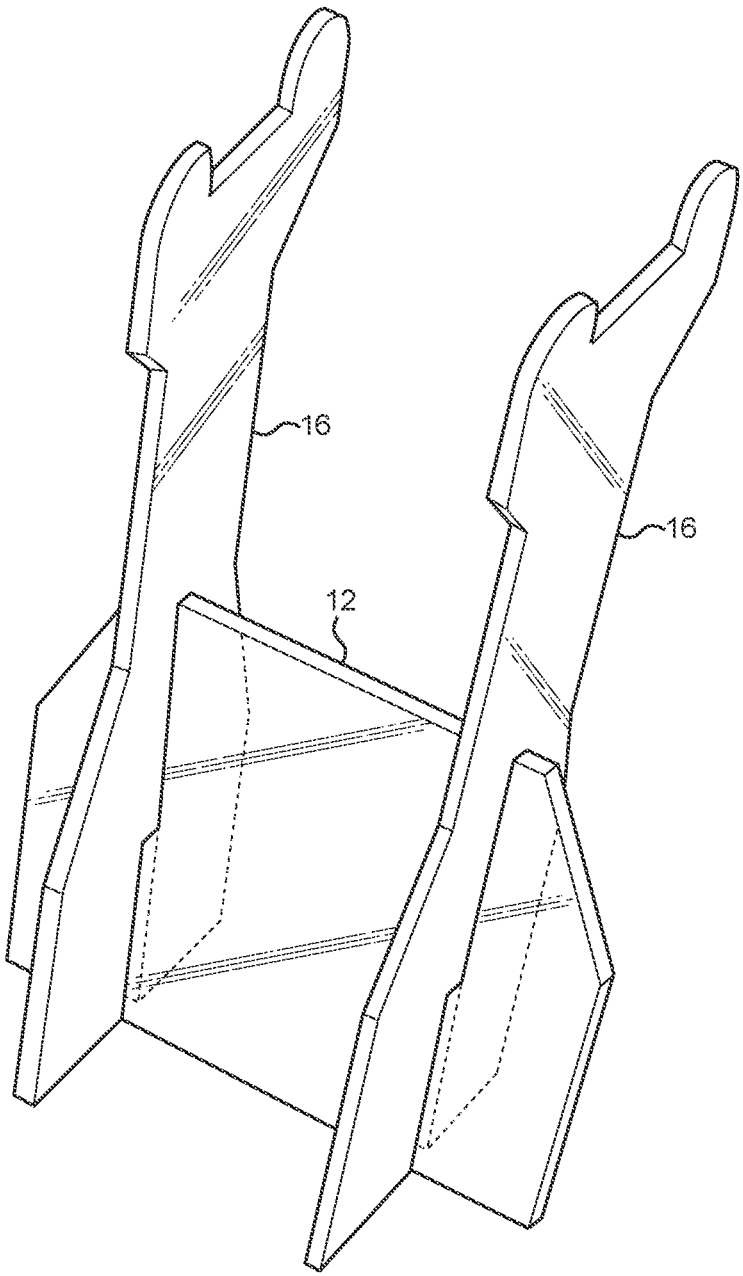
FIG. 6 shows a perspective view of a fifth alternative embodiment of the bag drying apparatus.

Referring to FIGS. 5-6, there is shown a perspective view of a fourth and fifth embodiments of the bag drying apparatus, respectively. Specifically referring to FIG. 5, the shown fourth alternative embodiment of the bag drying apparatus 11 includes a single panel 12 and a single board 16. Specifically referring to FIG. 6, the shown fifth alternative embodiment of the bag drying apparatus 11 includes a single panel 12 and a pair of boards 16 at an interval from each other. In this way, this embodiment is adapted to receive a larger bag, or multiple bags in an inverted open position.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bag drying apparatus, comprising:

a panel comprising a panel slot, the panel slot including an open first end accessible from a first end of the panel;

a board comprising a board slot, the board slot including an open first end accessible from a second end of the board;

whereupon an interconnection between the panel slot and the board slot, a second end of the panel and the second end of the board are each flushly disposable on a flat surface to configure the bag drying apparatus to receive and to maintain an inverted bag in an open configuration such that a liquid of the inverted bag is channeled away from the panel slot and the board slot.

2. The bag drying apparatus of claim 1, wherein the panel is disposed upright on a first vertical plane and the board is disposed upright on a second vertical plane.

3. The bag drying apparatus of claim 2, wherein the panel is aligned perpendicular to the board when coupled.

4. The bag drying apparatus of claim 1, wherein the panel comprises a fan.

5. The bag drying apparatus of claim 4, wherein the fan and the panel are aligned along a common horizontal plane.

6. The bag drying apparatus of claim 4, wherein the fan is aligned perpendicular to a plane of the panel.

7. The bag drying apparatus of claim 4, wherein the fan is aligned in parallel to a horizontal plane of the panel.

8. The bag drying apparatus of claim 4, wherein the fan is perpendicular to a horizontal plane of the panel and parallel to a ground surface supporting the bag drying apparatus.

9. The bag drying apparatus of claim 1, wherein the panel comprises a trapezoidal shape.

10. The bag drying apparatus of claim 1, wherein the board comprises a dumbbell shape.

11. The bag drying apparatus of claim 1, wherein the panel and the board are removably affixed to one another.

12. The bag drying apparatus of claim 1, wherein the panel and the board are planar members.

13. A modular bag drying apparatus, comprising:

a panel comprising a plurality of panel slots, wherein each panel slot of the plurality of panel slots includes an open first end accessible from a first end of the panel;

a plurality of boards including a first board and a second board, wherein each board of the plurality of boards comprises a board slot to produce a plurality of board slots, wherein each board slot of the plurality of board slots includes an open first end accessible from a second end of the board;

wherein the plurality of panel slots is configured to removably interlock with the plurality of board slots;

wherein the panel slots of the plurality of panel slots are spaced at intervals;

whereupon an interconnection between the plurality of panel slots and the plurality of board slots, a second end of the panel and the second ends of the boards of the plurality of boards are each flushly disposable on a flat surface to configure the bag drying apparatus to receive and to maintain an inverted bag in an open configuration such that a liquid of the inverted bag is channeled away from the panel slot and the board slot.

14. The modular bag drying apparatus of claim 13, wherein the panel slots of the plurality of panel slots are disposed on opposing sides of a fan.

15. The modular bag drying apparatus of claim 14, wherein the panel comprises the fan.

16. The modular bag drying apparatus of claim 15, wherein the fan and the panel are aligned along a common horizontal plane.

17. The modular bag drying apparatus of claim 15, wherein the fan is aligned perpendicular to a plane of the panel.

18. The modular bag drying apparatus of claim 15, wherein the fan is aligned in parallel to a horizontal plane of the panel.

19. The modular bag drying apparatus of claim 15, wherein the fan is perpendicular to a horizontal plane of the panel and parallel to a ground surface supporting the bag drying apparatus.

20. The modular bag drying apparatus of claim 13, wherein the panel and each board of the plurality of boards are removably affixed to one another.

* * * * *